US005445118A

United States Patent [19]

Hudson

[11] Patent Number: 5,445,118

[45] Date of Patent: Aug. 29, 1995

[54] VALVE TRAIN ASSEMBLY FOR INTERNAL COMBUSTION ENGINE

[75] Inventor: Eric B. Hudson, Hilbert, Wis.

[73] Assignee: Brunswick Corporation, Lake Forest, Ill.

[21] Appl. No.: 231,427

[22] Filed: Apr. 22, 1994

[51] Int. Cl.[6] ..... F01L 1/18; F01L 1/20

[52] U.S. Cl. ..... 123/90.27; 123/90.41; 123/90.42; 123/90.43

[58] Field of Search ..... 123/90.27, 90.39, 90.41, 123/90.42, 90.43, 90.45, 90.48, 90.61

[56] References Cited

U.S. PATENT DOCUMENTS

| | | | |
|---|---|---|---|
| 3,531,234 | 9/1970 | Ravenel | 123/90.61 |
| 3,614,943 | 6/1970 | Schley | 123/90.42 |
| 3,661,127 | 5/1972 | Cornell | 123/90.27 |
| 3,880,127 | 4/1975 | Abell, Jr. | 123/90.42 |
| 4,227,495 | 10/1980 | Krieg | 123/90.43 |
| 4,333,426 | 6/1982 | Gavasso et al. | 123/90.27 |
| 4,505,236 | 3/1985 | Nakamura | 123/90.27 |
| 4,671,222 | 6/1987 | Gallot et al. | 123/90.43 |
| 4,979,475 | 12/1990 | Mills | 123/90.41 |

FOREIGN PATENT DOCUMENTS

| | | | |
|---|---|---|---|
| 866872 | 5/1961 | United Kingdom | 123/90.41 |

*Primary Examiner*—Willis R. Wolfe

*Assistant Examiner*—Weilun Lo

*Attorney, Agent, or Firm*—Wood, Phillips, VanSanten, Clark & Mortimer

[57] ABSTRACT

In order to eliminate components in an internal combustion engine, and to thereby reduce the cost and weight while enhancing compactness in a rigid yet quiet arrangement, a valve train assembly is disclosed. The internal combustion engine has a valve with an integral valve stem, a valve lifter in engagement with a cam, and a rocker arm in engagement with the valve stem. The valve train assembly is such that the rocker arm is in engagement with the valve lifter at a first point along its length and is in engagement with the valve stem at a second point along its length. The rocker arm has a recess at the first point along its length for receiving and engaging the valve lifter therein. The valve train assembly is also such that the rocker arm has a surface at the second point along its length to thereby move the valve in response to movement of the valve lifter. The internal combustion engine also includes a mounting for the rocker arm at a point intermediate the first and second points along its length for pivotal movement thereof. With these features, the valve train assembly is such that movement of the valve lifter is imparted through the rocker arm to the valve stem in a most highly efficient and compact manner in a quiet internal combustion engine.

11 Claims, 3 Drawing Sheets

VALVE TRAIN ASSEMBLY FOR INTERNAL COMBUSTION ENGINE

FIELD OF THE INVENTION

The present invention is generally directed to improvements in internal combustion engines and, more particularly, an internal combustion engine of the overhead cam type having a unique valve train assembly.

BACKGROUND OF THE INVENTION

Over the years, it is well recognized that there have been many significant advancements in the internal combustion engine field that have greatly facilitated this important source of power. It is also well known that internal combustion engines have been put to use in a most successful manner in a variety of diverse applications. Generally speaking, they range from small engines, such as those used on lawn mowers, tillers, chain saws and the like, to much larger engines such as those used in automobiles, trucks, and even propeller-driven aircraft.

In the marine industry, internal combustion engines are widely utilized for different applications. They may be used in the form of an outboard motor to be attached to the stem of a boat, as the power source for an inboard-outboard type of boat, or as the power source for a direct drive inboard boat. For these applications and others, there are needs that must be met in order for the engine to be practical.

Of course, there have been many developments in this field that have greatly enhanced the performance that can be expected from such engines. It is, nonetheless, the case that improvements are still required in terms of reducing costs, enhancing compactness, increasing "stiffness", and reducing weight in an internal combustion engine valve train for a variety of different engine applications. Accordingly, the present invention is directed to overcoming one or more of the foregoing problems and achieving one or more of the resulting objects.

SUMMARY OF THE INVENTION

It is therefore a principal object of the present invention to provide an improved internal combustion engine. It is a further object of the present invention to provide an internal combustion engine which is of the overhead cam type having an improved valve train assembly. It is an additional object of the present invention to provide for low cost, enhanced compactness, increased "stiffness" and reduced weight.

Accordingly, the present invention is directed to an internal combustion engine having a valve with an integral valve stem, a valve lifter which is in engagement with a cam, and a rocker arm which is in engagement with the valve stem. The engine is such that the rocker arm is also in engagement with the valve lifter at a first point along its length and is in engagement with the valve stem at a second point along its length. One of said rocker arm and valve lifter, the rocker arm in the preferred embodiment, has recess means where said rocker arm and valve lifter are in engagement at said first point along the length of said rocker arm; more particularly, the rocker arm preferably has recess means which is positioned at the first point along its length for receiving and engaging the valve lifter therein. The engine is also such that the rocker arm has a surface which is positioned at the second point along its length for engaging the valve stem to impart movement to the valve. With these features, the internal combustion engine also includes means for mounting the rocker arm for pivotable movement intermediate the first and second points along its length whereby movement of the valve lifter is imparted through the rocker arm to the valve stem.

In the exemplary embodiment, the valve lifter includes a lifter head in engagement with the cam and a lifter stem in engagement with the recess means in the rocker arm. The lifter head advantageously has a flat surface engaging the cam whereas the; lifter stem has a hemispherical end engaging the recess means in the rocker arm. Preferably, the rocker arm is formed such that the recess means is a short groove with radiused sides which is adapted to receive the hemispherical end of the lifter stem therein.

In the preferred embodiment, the cam has a surface in engagement with the lifter head to drive the valve lifter in response to rotational movement of the cam. Still additionally, the lifter stem is advantageously in a bore to thereby limit the valve lifter solely to axial movement in response to rotational movement of the cam. The limitation to axial motion combined with engagement of the upper stem in the groove of the rocker arm constrains the rocker arm to one plane of motion about its pivot point.

In a most highly preferred embodiment, the internal combustion engine is of the overhead cam type having a valve train assembly such as that described herein. The valve is then preferably moveable between an open position and a closed position to control communication between a port and a cylinder, and the valve cooperates with a valve seat in the closed position to close off communication between the port and the cylinder and is moveable away from the valve seat to the open position to thereby permit communication between the port and the cylinder. With this understanding, it will be appreciated that the valve advantageously has an integral valve stem which extends from the valve seat and the cylinder generally to a point remote therefrom.

With regard to the valve lifter, it preferably has a first end, i.e., the lifter head, which is in engagement with the cam and a second end, i.e., the lifter stem, which is remote therefrom. The rocker arm is preferably generally elongated so as to be in engagement with the second, or lifter stem, end of the valve lifter at the first point along its length and in engagement with the valve stem at the second point along its length, and the short groove or pocket of the rocker arm is positioned at the first point along its length for the purpose of receiving and engaging the second, or lifter stem, end of the valve lifter. Still additionally, the mounting means for the rocker arm preferably includes ball and socket joint means defined by the rocker arm and a stud positioned between the valve lifter and the valve stem.

In a most highly preferred embodiment, the lifter stem and the valve stem are disposed in approximately parallel relation and the valve is spring biased toward the closed position where it cooperates with the valve seat. The rocker arm advantageously spans between the valve stem and the hemispherical end of the lifter stem and is pivotally mounted on a stud disposed parallel to the valve and lifter stems. Preferably, the ball and socket joint means also includes a generally hemispherical recess in the rocker arm as well as a generally hemispherical surface which is provided on one end of the stud.

For this purpose, the generally hemispherical recess for the stud preferably also has a stud-receiving elongated slot extending generally in a direction from the first point toward the second point along the length of the rocker arm to accommodate angular rotation. The stud is advantageously fixedly mounted at one end to a head of the engine and is threaded, in the most highly preferred embodiment, at the other end to receive a nut having the generally hemispherical surface on the rocker arm side which functions as a pivot. The threaded engagement of the nut and stud provides a means of valve clearance adjustment. As for the groove, it is elongated in a direction from the first point toward the second point along the length of the rocker arm.

An analysis of the pivoting motion of the rocker arm in comparison with the linear paths of the valve lifter and valve reveals that the valve lifter end will slide in the groove a short distance during operation; similar sliding occurs at the rocker arm-to-valve stem interface.

Other objects, advantages and features of the present invention will become apparent from a consideration of the: following specification taken in conjunction with the accompanying drawings.

DETAILED DESCRIPTION OF THE PREFERRED EMBODIMENT

Figure 1:
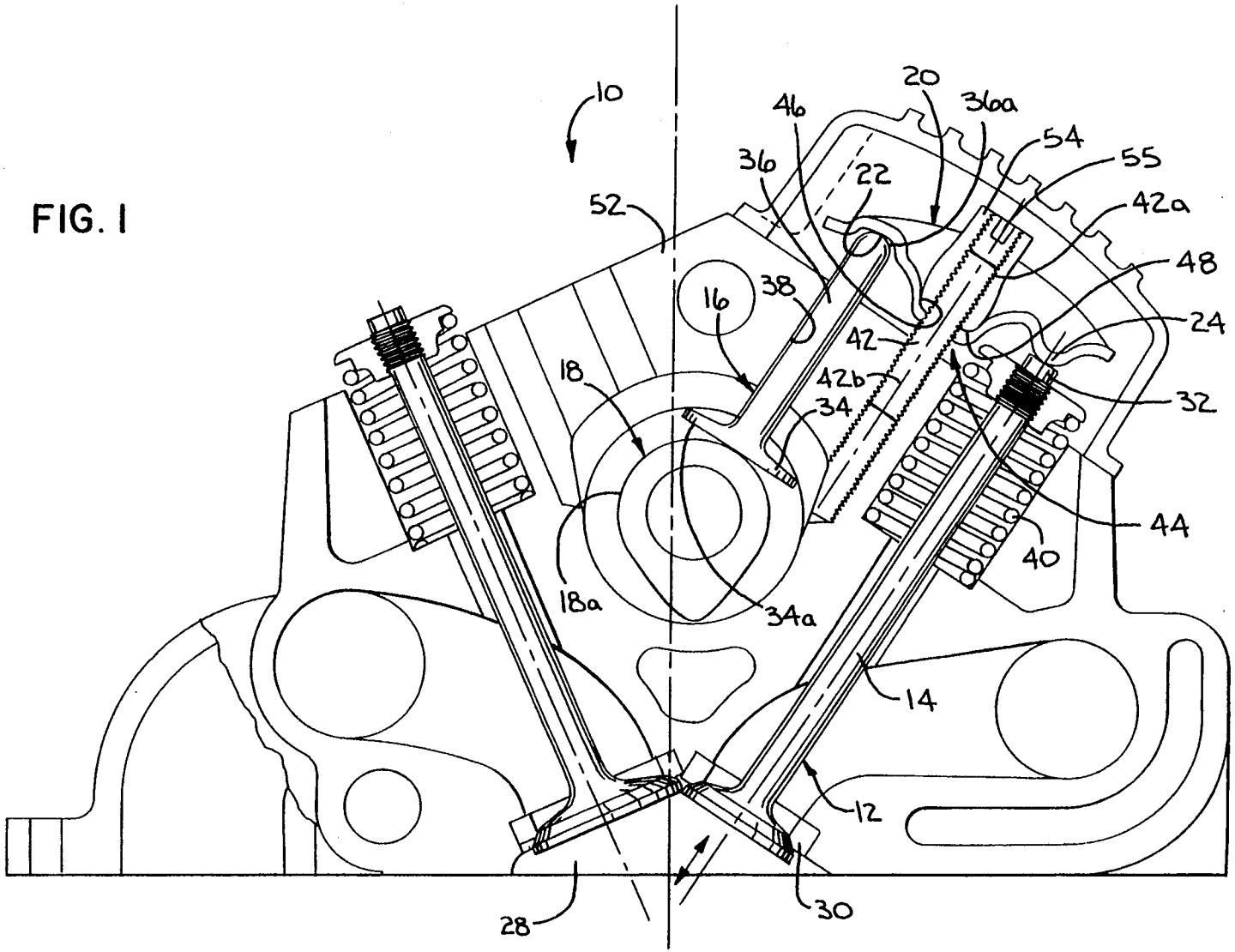
FIG. 1 is a cross-sectional view of a portion of an internal combustion engine having a valve train assembly in accordance with the present invention.
Figure 2:
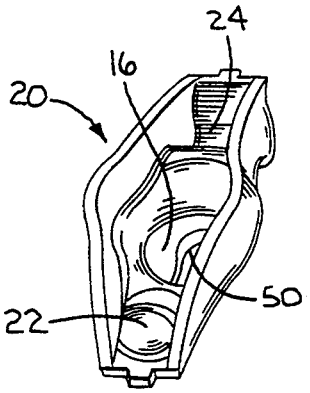
FIG. 2 is a perspective view of a rocker arm for the train assembly as illustrated in FIG. 1.

In the illustrations given, and with reference first to FIG. 1, the reference numeral 10 designates generally an internal combustion engine incorporating a unique valve train assembly in accordance with the present invention. The engine 10 has a valve 12 with an integral valve stem 14, a valve lifter 16 which is in engagement with a cam 18, and a rocker arm 20 which is in engagement with the valve stem 14. The rocker arm 20 is also in engagement with the valve lifter 16 at a first point along its length and is in engagement with the valve stem 14 at a second point along its length. One of said rocker arm 20 and valve lifter 16 (the rocker arm 20 in the preferred embodiment) has recess means where said rocker arm 20 and valve lifter 16 are in engagement at said first point along the length of said rocker arm 20. The rocker arm 20 will be seen to have recess means in the form of a groove 22 at the first point along its length for receiving and engaging the valve lifter 16 therein. The engine 10 is also such that the rocker arm 20 has a surface 24 which is located at the second point along its length for engaging the valve stem 14 to impart movement to the valve 12. With these features, the internal combustion engine 10 also includes means for mounting the rocker arm 20 for pivotable movement intermediate the first and second points along its length whereby movement of the valve lifter 16 is imparted through the rocker arm 20 to the valve stem 14.

Still referring to FIG. 1, the invention has been illustrated in connection with an overhead cam type internal combustion engine 10 having the inventive valve train assembly disclosed herein. Of course, it will also be appreciated that the internal combustion engine 10 will have separate intake valve and exhaust valves for each cylinder. However, for purposes of understanding the invention, the internal combustion engine 10 has been described in conjunction with only one of the valves to avoid any unnecessary complication.

In addition, only a portion of the internal combustion engine 10 has been illustrated to simplify the description and thereby enhance the understanding of the invention. It will be understood, in particular, that FIG. 1 simply illustrates the valve train for a single one of the cylinders, and, even then, the invention has only been illustrated in conjunction with one of the valves. Nevertheless, and as will be appreciated by those skilled in the art, the invention can be applied to the valves of all of the cylinders in virtually any internal combustion engine.

With this background, the valve 12 will be understood to be moveable as suggested by the double-headed arrow between an open position and a closed position to control communication between a port 26 and a cylinder 28. The valve 12 cooperates with a valve seat 30 in the closed position to close off communication between the port 26 (herein illustrated as the exhaust port) and the cylinder 28, and it is moveable away from the valve seat 30 to the open position to thereby permit communication between the port 26 and the cylinder 28. With this understanding, the valve 12 will be seen to have an integral valve stem 14 extending from the valve seat 30 and the cylinder 28 generally to a point remote therefrom as at 32.

Still referring to FIG. 1, it will be understood and appreciated that the valve lifter 16 has a first end which is in engagement with the cam 18 and a second end which is remote therefrom. More specifically, the valve lifter 16 has a lifter head 34 in engagement with the cam 18 and a lifter stem 36 in engagement with the groove 22 in the rocker arm 20 wherein the lifter stem 36 preferably has a hemispherical end **36*a* engaging the groove 22 in the rocker arm 20. In this connection, the groove 22 at the first point along the rocker arm 20 advantageously has radiused sides for receiving the hemispherical end 36*a* of the lifter stem 36** therein.

As shown in FIG. 1, the lifter stem 36 is disposed in a bore 38 to limit the valve lifter 16 to axial, i.e., linear, movement which is imparted through the lifter head 34 in response to rotational movement of the cam 18. The lifter stem 36 and the valve stem 14 are disposed in generally parallel relation, and the valve 12 is biased by means of a spring 40 toward the closed position where it cooperates with the valve seat 30. Still additionally, the rocker arm 20 will be seen to span between the valve stem 14 and the hemispherical end **36*a* of the lifter stem 36, and it is pivotably mounted on a stud 42 also disposed generally parallel to the valve stem 14 and the lifter stem 36**.

Referring to FIGS. 2–7, in conjunction with FIG. 1, the rocker arm 20 is generally elongated for engagement with the hemispherical second end **36*a* of the valve lifter 16 at the first point along its length and engagement with the remote end 32 of the valve stem 14 at the second point along its length. The groove 22 in the rocker arm 20 will also be understood as being at the first point along the length of the rocker arm 20 for receiving and engaging the hemispherical second end 36***a* of the valve lifter 16, and the rocker arm 20 has the valve stem engaging cylindrical surface 24 at the second point along its length for engaging and moving the valve stem 14 to control the valve 12. With the pivotable mounting which is provided by the stud 42, the rocker arm 20 will be understood to be mounted generally intermediate the first and second points along its length to thereby impart movement of the valve lifter 16 in response to the cam 18 to the valve stem 14.

Referring in particular to FIG. 1, the lifter head 34 will be seen to have a flat surface 34*a* in engagement with a cam surface 18*a* of the cam 18 to thereby drive the valve lifter 16 in response to rotational movement of the cam 18. It will also be seen in FIG. 1 that the mounting means includes ball and socket joint means generally designated 44 and defined by the rocker arm 20 and the stud 42 which is mounted in a fixed position between, and generally parallel to, the valve lifter 16 and the valve stem 14. More specifically, the ball and socket joint means preferably includes a generally hemispherical recess 46 in the rocker arm 20 and a generally hemispherical surface 48 which is provided on one end 42*a* of the stud 42 (see also FIGS. 2–4 and 6).

Figure 3:
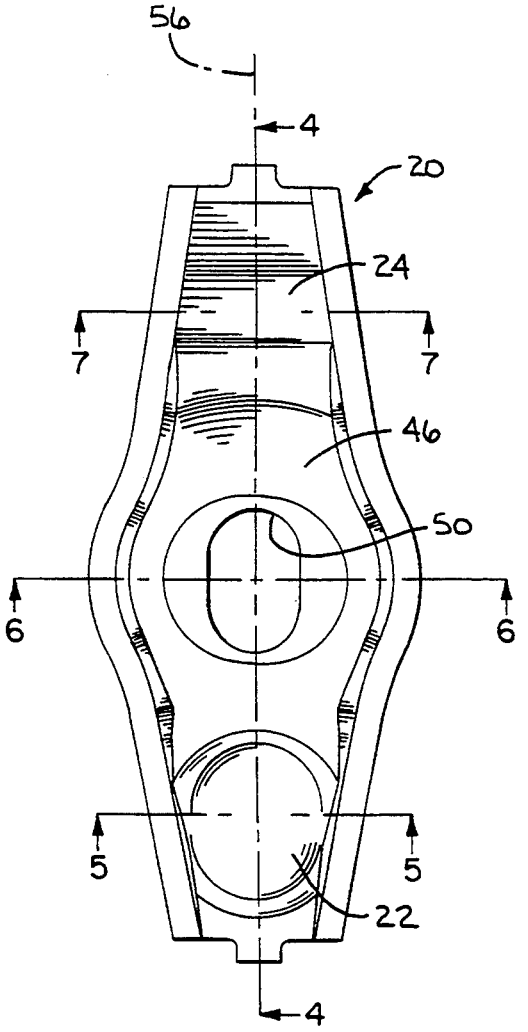
FIG. 3 is a top plan view of the rocker arm for the train assembly as illustrated in FIG. 1.

As best shown in FIG. 3, the generally hemispherical recess 46 has a stud-receiving elongated slot 50 extending generally in a direction from the first point toward the second point along the length of the rocker arm 20. The stud is advantageously fixedly mounted at one end 42*b* as by threads or the like (see FIG. 1) to a head 52 of the engine 10 and is threaded at the other end 42*a* to receive a nut 54. While the generally hemispherical surface 48 may be integrally formed on the stud 42, it is advantageous for the nut to be threaded onto the stud 42 and to be formed so as to have the generally hemispherical surface 48.

The threaded engagement of nut 54 and stud 42 provides a means of adjusting the mechanism for wear and proper running clearance. A set screw 55 is shown threaded into nut 54 in FIG. 1. The set screw 55 is tightened against the end of the stud 42*a* to prevent motion of the threaded joint of the nut 54 and stud 42.

Figure 4:
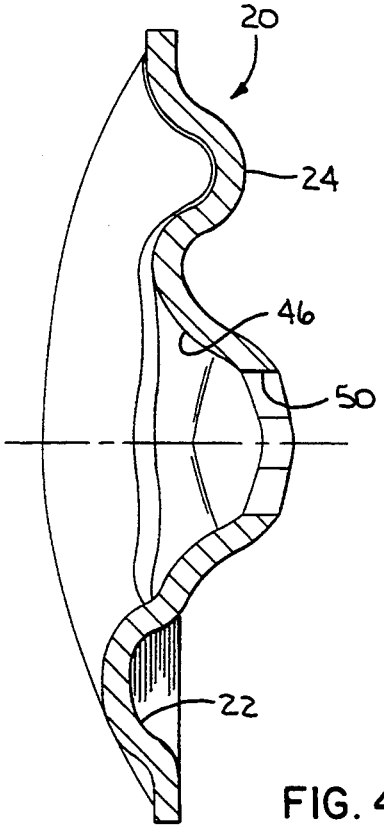
FIG. 4 is a cross-sectional view of the rocker arm taken generally along the line 4—4 of FIG. 3.
Figure 5:
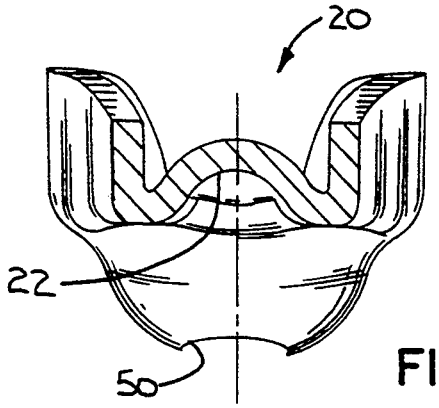
FIG. 5 is a cross-sectional view of the rocker arm taken generally along the line 5—5 of FIG. 3.
Figure 6:
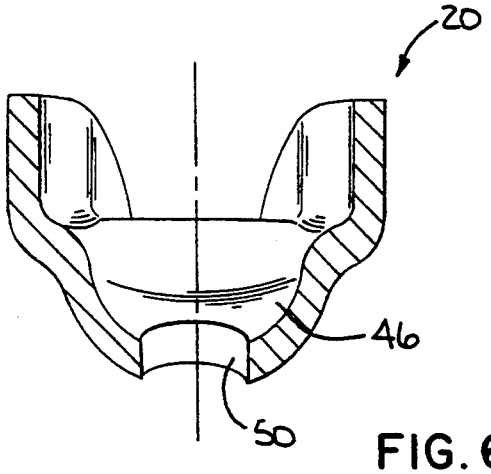
FIG. 6 is a cross-sectional view of the rocker arm taken generally along the line 6—6 of FIG. 3.
Figure 7:
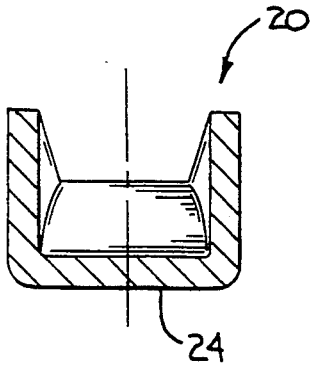
FIG. 7 is a cross-sectional view of the rocker arm taken generally along the line 7—7 of FIG. 3.

Referring now to FIGS. 3–5, the groove 22 will be seen and understood to be elongated generally in a direction from the first point toward the second point along the length of the rocker arm 20, i.e., along the generally longitudinal axis 56 thereof. As for the surface 24 at the second point along the length of the rocker arm 20, FIGS. 4 and 7 will be seen and understood as illustrating this generally cylindrical surface in the form of a projection extending from the rocker arm 20 in a direction opposite the groove 22 at right angles to the longitudinal axis 56.

As will be fully appreciated from the foregoing description, the invention provides what can accurately be described as an overhead cam center pivot rocker arm-/lifter assembly for an internal combustion engine. A principal advantage is that the mushroom-style lifter 16 with the hemispherical end 36*a* disposed in the groove 22 eliminates the need for any additional devices to keep the rocker arm 20 in alignment during engine operation. The lifter 16 is restrained to axial movement in the bore 38, and the rocker arm 20 has a second generally hemispherical recess 46 which is part of a ball and socket joint along with the stud 42 and nut 54. With this arrangement, the force of the spring 40 on the valve 12 will maintain the end 24 of the valve stem 14 in contact or close proximity to the surface 24 at the second end of the rocker arm 20 opposite the lifter 16. As will be appreciated, the pivoting components are maintained in close contact witch the hemispherical end 36*a* of the lifter 16 in the groove 22 in the rocker arm 20. The path of the hemispherical end 36*a* of the lifter 16, as the lifter follows the cam 18, and the pivot center, i.e., the center of the elongated slot 50, generally define the plane of motion in which the rocker arm 20 is restricted. Moreover, the groove 22 for the hemispherical end 36*a* of the lifter 16 allows for sliding motion in this plane of motion to achieve the invention objectives.

With this arrangement, there are numerous advantages in using the mushroom-type lifter 16 with a center pivot rocker arm 20 in an overhead cam type of internal combustion engine 10. Among other advantages are the elimination of a device to hold the rocker arm in alignment with the plane of the lifter and valve stem, the compactness achieved by the close proximity of the small diameter lifter and stem to the stud on which the rocker arm pivots, the ability to use an inexpensive cold-headed lifter similar to typical small engine practice and stampings for the rocker arms, and the ability to use die east or powdered metal "pivots" with roll-formed studs and locking screws. From these advantages, it follows that the invention makes it possible to achieve low cost, enhanced compactness, reduced weight and high rigidity in a quiet internal combustion engine.

While in the foregoing a detailed description of the preferred embodiment of the invention has been set forth, it will be appreciated that the details herein given may be varied by those skilled in the, art without departing from the true spirit and scope of the appended claims.

What is claimed is:

1. In an overhead cam internal combustion engine having an engine block with at least one cylinder therein, a cylinder head, a poppet valve with a valve stem and a drive train for operating said valve including a rocker arm, a valve lifter and a cam shaft with a cam to drive the valve lifter, an improvement comprising:

(a) a center pivot rocker arm having one end comprising an elongated axial recess opening toward the valve lifter;

(b) a valve lifter having a rigid stem riding within a bore in the cylinder head and restricted by the bore to movement along the axis thereof, and a cam following head in contact with a valve actuating cam on the cam shaft, the rigid stem having an end opposite the cam following head terminating in a rounded tip;

(c) means for pivotally mounting the rocker arm at a selected point on the cylinder head between the valve stem and the lifter stem; and (d) means for maintaining the rounded tip of the lifter stem within the recess in one end of the rocker arm and the other end of the rocker arm in operating engagement with the valve stem, (e) so that the force of the tip of the lifter stem acting within the recess of the rocker arm and the selected pivot point of the rocker arm control the alignment of the rocker arm with respect to the valve stem.

2. The internal combustion engine of claim 1 wherein the end of the rocker arm opposite the elongated recess comprises an arcuate section, the tip of the valve stem is generally flat and wherein eh arcuate section of the rocker arm is in sliding contact upon the flat tip of the valve stem.

3. The internal combustion engine of claim 1 wherein said means for pivotally mounting the rocker arm includes a ball and socket joint defined by the rocker arm and a pivot positioned between the valve lifter stem and the valve stem.

4. The internal combustion engine of claim 1 wherein the stem and head of the valve lifter comprise an integral structure.

5. The internal combustion engine of claim 1 wherein the valve stem and lifter stem axes lie substantially within a common plane.

6. The internal combustion engine of claim 1 wherein the means for pivotally mounting the rocker arm comprises a ball and socket joint defined by a generally hemispherical member in contact with a generally hemispherical recess positioned centrally of the rocker arm, and means for securing the hemispherical member to the cylinder head.

7. The internal combustion engine of claim 6 wherein the means for securing the hemispherical member to the cylinder head comprises a threaded stud protruding from the cylinder head and wherein the hemispherical member has a threaded bore therethrough whereby the hemispherical member may be adjustably threaded onto the stud.

8. The internal combustion engine of claim 1 wherein the threaded stud has an upper end terminating within the threaded bore of the hemispherical member and the securing means further comprises a set screw screwable into the threaded bore in the hemispherical member and against the upper end of the stud, whereby the hemispherical member is locked in position upon the stud.

9. The internal combustion engine of claim 6 wherein the generally hemispherical recess within the rocker arm has a stud receiving elongated slot therein extending through the rocker arm and generally in a direction from one end toward the other end along the length of the rocker arm.

10. The internal combustion engine of claim 7 wherein the stud is fixedly mounted at one end to the cylinder head of the engine and is threaded at the other end to receive thereon the generally hemispherical member.

11. The internal combustion engine of claim 6 wherein the means for securing the hemispherical member to the cylinder head comprises a threaded stud protruding from the hemispherical member along a radius thereof and a cylinder head having a threaded bore therein, the threaded stud being adjustably threadable into the bore in the cylinder head to position the same with respect to the cylinder head and the hemispherical recess of the rocker arm.

* * * * *